United States Patent [19]

Oliver

[11] 4,226,104

[45] Oct. 7, 1980

[54] REMOVABLE PROTECTOR FOR LOCKS

[76] Inventor: Melvin D. Oliver, 4310 N. Carlisle St., Philadelphia, Pa. 19140

[21] Appl. No.: 933,457

[22] Filed: Aug. 14, 1978

[51] Int. Cl.[2] ..... E05B 17/14

[52] U.S. Cl. ..... 70/455; 70/DIG. 58; 70/423

[58] Field of Search ..... 70/423, 455, DIG. 58, 70/424–428, 211–212; 292/DIG. 2

[56] References Cited

U.S. PATENT DOCUMENTS

| | | | |
|---|---|---|---|
| 3,434,318 | 3/1969 | Thiry | 70/455 |
| 3,502,369 | 3/1970 | Trammell | 70/DIG. 58 |

FOREIGN PATENT DOCUMENTS

| | | | |
|---|---|---|---|
| 1902467 | 10/1970 | Fed. Rep. of Germany | 70/455 |
| 217649 | 3/1967 | Sweden | 70/DIG. 58 |

*Primary Examiner*—Robert L. Wolfe

*Attorney, Agent, or Firm*—Weiser, Stapler & Spivak

[57] ABSTRACT

A removable protector for a locking mechanism, such as a door knob or window lock is disclosed. The protector comprises a magnetically attractive member, such as a circular base plate, surrounding the locking mechanism and a housing magnetically attached thereover to discourage access. The housing is dome shaped in configuration and has an aperture to receive a lever whereby the housing may be removed from the circular plate to allow full access to the lock.

7 Claims, 10 Drawing Figures

REMOVABLE PROTECTOR FOR LOCKS

BACKGROUND OF THE INVENTION

The present invention is a protective device for preventing unauthorized tampering with locking mechanisms and particularly is adopted for use with lock type door knobs to which access is generally easily possible by breakage of an adjacent window.

Various devices are known for providing protection for locking mechanisms. U.S. Pat. No. 3,660,996 describes a permanently attached, hinged cover for a door knob which can be secured by means of a key lock. The locking button of the door knob is accessible by means of a hole in the cover.

Another door handle cover is disclosed in U.S. Pat. No. 3,210,972. The cover comprises a five sided box which is attached by applying the box over the door knob, then inserting the sixth side and locking with a key lock.

U.S. Pat. No. 4,007,956 describes a permanent tube type cover which allows a key to be inserted in the door knob but includes construction to prevent the prying off of the knob itself from the shaft.

Another door knob protection device can be found in U.S. Pat. No. 2,458,002.

Automotive keyhole covers are described in U.S. Pat. Nos. 3,421,350, 3,782,149 and 3,861,182. These devices completely cover the keyhole and protect the mechanism within the door from water and ice. They may be attached by magnets in the cover itself. Another keyhole protection is offered in U.S. Pat. No. 4,073,165.

Even though considerable work has heretofore been undertaken in an effort to removably cover locks, a need exists for a cover which is completely removable, which need not be secured with a key lock and yet which effectively discourages tampering with the enclosed locking mechanism. An object of this invention is to provide a device utilizing such a cover.

SUMMARY OF THE INVENTION

A removable housing to protect a window or door lock from tampering is provided which is secured by one or more magnets in various configurations around the locking mechanism.

The removable protector of the present invention comprises generally a base which is attached to the window or door construction in secure manner such as by employing screws. The base may be formed in the configuration of an annular ring or otherwise as may be necessary to peripherally surround at least a major portion of the window or door locking mechanism.

The protector housing or cover is rounded and smooth to discourage easy removal and preferably is dome shaped in configuration to present a pleasing appearance while at the same time providing an external construction that is quite difficult to tightly grasp for removal purposes. Magnetic means are interposed between the base plate and the housing to magnetically secure the parts together. Preferably, the cover is formed to provide a small top opening of size to permit insertion of the hook or lever of a small hard tool which is suitably designed to apply sufficient separating forces to overcome the magnetically attractive forces to pull the cover from the base.

It is, therefore, an object of the present invention to provide an improved removable protector for locks of the type set forth.

It is another object if the present invention to provide a novel removable cover for locks comprising a base, a housing and magnetic means retaining the parts.

It is another object of the invention to provide a protection device for a door knob or other locking mechanism which is adjacent to an outside window of a home or other building to prevent access to the locking mechanism from the outside by merely breaking the window.

It is another object of the present invention to provide a removable protection for locks comprising a base of magnetically attractive material permanently secured to the door or window construction, a dome shaped cover including a circumferential magnet to removably seat upon the base and a tool engagable upon the cover to pull the cover from the base when access to the lock is desired.

It is another object of the present invention to provide a removable cover for locks that is simple in design, rugged in construction and trouble free when in use.

Other objects and a fuller understanding of the invention will be had by referring to the following description and claims of a preferred embodiment thereof, taken in conjunction with the accompanying drawings, wherein like reference characters refer to similar parts through the several views, and in which:

DESCRIPTION OF THE PREFERRED EMBODIMENTS OF THE INVENTION

Figure 2:
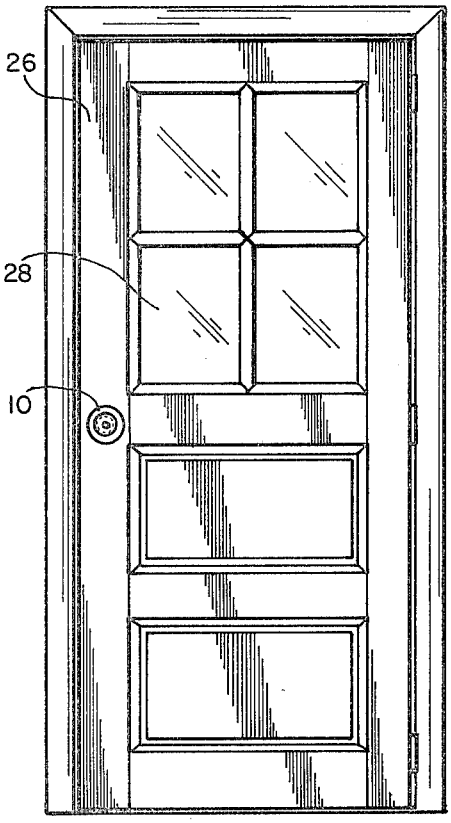
FIG. 2 is a elevational view showing the device applied to a door.

Although specific terms are used in the following description for the sake of clarity, these terms are intended to refer only to the particular structure of the invention selected for illustration in the drawings and are not intended to define or limit the scope of the invention.

The removable protector 10 of the present invention comprises a base 12 which is adapted to be secured about the object 16 to be protected and a cover or housing 14. The cover 14 may be magnetically removably attached to the base 12 and may be removed therefrom by utilizing a lever or other suitable tool which is engageable in a hole provided in the cover to pull the cover 14 from the base 12.

The object to be protected may be virtually any three dimensional object. However, the invention is especially adapted for use with locking mechanisms which may be tampered with after breakage of an adjacent window pane. That is, burglars who seek to gain entry to a house may break a window, reach in and easily unlock a window lock or door lock. Thereafter, entry can readily be gained into the building interior through the unlocked window or door. However, it is recognized that even if such an entry-way cannot be absolutely secured against an unauthorized breaking and entering, devices which force the unauthorized person to expend more time at the breaking may cause the person to abandon the attempt. Thus, the device will be effective evn if it cannot totally prevent entry provided it causes so much additional time and effect that the would-be burglar will be discouraged and give up the attempt at unauthorized entry.

The base 12 of device 10 may be circular, square, rectangular or any irregular shape as long as it extends peripherally outwardly from the locking mechanism to be protected. The base 12 is permanently attached to the lock mechanism support such as the door 26 to which a door knob 16 is attached. Attachment of the base 12 may be with conventional screws 20, epoxy glue or any other suitable means. The base can be fabricated of any material such as steel or iron which is attracted by magnets, such as the circular magnets 18 contained in the dome shaped housing 14. Alternatively, the base 12 may be a laminate of metals, plastics or other materials as long as the exposed surface is attractive to the magnet.

If desired, the magnet 18 could be contained in the base 12 and the housing could be adapted to have a metallic surface which was attractive to the magnet in the base.

In another embodiment of the invention, both the base and the housing could have magnetic parts which seat onto and come into contact with each other when the cover is applied over the base. In this embodiment, the magnets are adapted so that the cover can be secured to the base by magnetic attraction, with the respective magnetic poles in magnetically attractive orientation.

Referring now to FIGS. 1–4, the device 10 is illustrated as applied directly to a door construction 26 and to a window assembly 30. In each instance, the respective base 12, 36 is secured about the lock 16, 38 by inserting screws 20, 40 or other known fasteners. The housing 14, 34 in FIGS. 1 and 4 contains magnetic portion 18 which may be an integral part of the cover or may be a separate magnet which has been attached with screws or glue or other means to the housing. The housing or cover 14, 34 may be of any shape, such as cylindrical or hemispherical, and may have a decoration applied thereon. However, since the prying off of the housing from the base should only be easily accomplished with the use of a separate tool, for example a lever tool 22, its shape should not be easy to grasp. Thus, the shape is preferably hemispherical in configuration. The housing 14 may be fabricated of metal, plastic or any material adapted to hold the circular magnet 18.

A housing removal means in the form of an aperture 24 is provided in the cover 14 and preferably is only wide enough to allow insertion of the hook portion of the special lever tool 22. Thus, the aperture 24 will be too narrow for insertion of a screwdriver or other tool which a burglar might be expected to carry. The lever tool 22 has an extension portion 23 which terminates a perpendicular bend or hook portion which when inserted into the aperture 24, can exert sufficient pressure against door knob 16 or which may permit the application of pulling forces sufficient to dislodge the housing 14 to expose the door knob 16.

Figure 3:
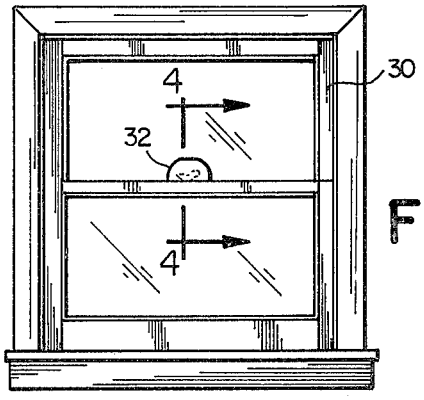
FIG. 3 is an elevational view showing the device applied to a window to protect a window lock.
Figure 4:
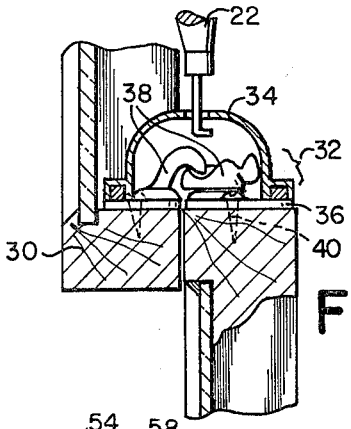
FIG. 4 is an enlarged cross sectional view taken along line 4—4 on FIG. 3.

FIG. 2 depicts a door 26 having a window pane 28 in close proximity to the door knob 16 over which the device 10 is attached. FIG. 3 shows a window 30 having a modified device 32 of the invention adapted to be attached over a standard window lock. As shown in FIG. 4, the window device 32 comprises a dome shaped housing 34 and base 36 which is attached by screws 40 into the window frame to the window lock 38.

Figure 5:
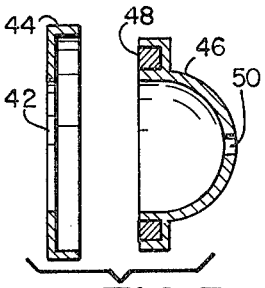
FIGS. 5–7 depict embodiments wherein the magnet is part of the housing and flanges may be used in the base.
Figure 6:
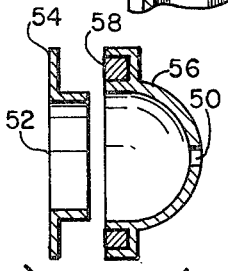
Figure 7:
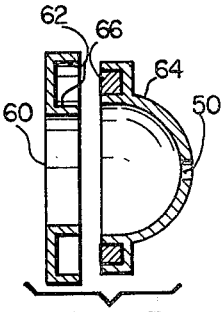
Figure 1:
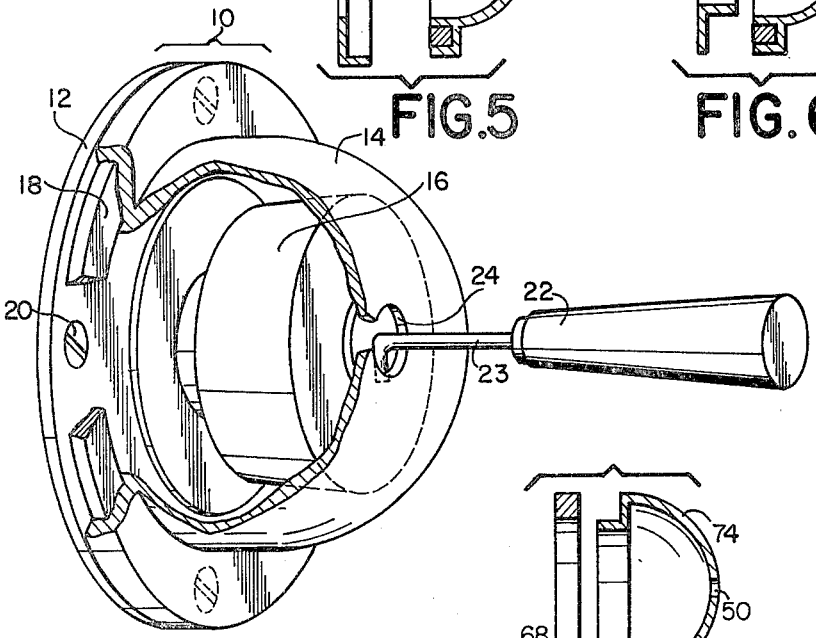
FIG. 1 is a perspective view of the invention showing the device applied to a door knob, partly broken away to expose interior construction details.

In other embodiments of the invention, either the housing or the base may be provided with a flange in order to make sideways movement of the housing relative to the base more difficult. As illustrated in FIGS. 5, 6 and 7, side views of other embodiments of hemispherical housing and circular base assemblies are shown wherein the respective bases 42, 52 and 60 have flanges 44, 54 and 62 which project outwardly from the bases and wherein the bases are fabricated of magnetic attractive material such as iron or steel. The cooperating respective housings 46, 56 and 64 are equipped with magnets 48, 58 and 66 which are mechanically secured thereto in any known, reliable manner. As indicated previously, either the housings or the bases may be magnetic and in reference to the embodiments illustrated in FIGS. 5, 6 and 7, this could simply be effected by fabricating the respective bases 42, 52 and 60 with permanent magnetic materials.

Figure 8:
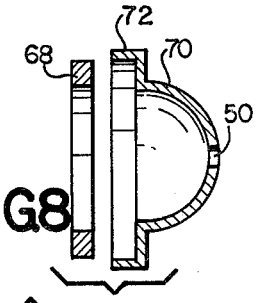
FIGS. 8–10 depict embodiments wherein the magnet is part of the base and the housing may have one or more flanges.
Figure 9:
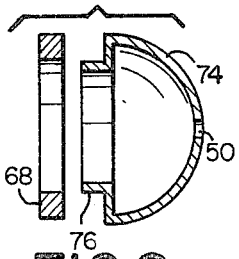
Figure 10:
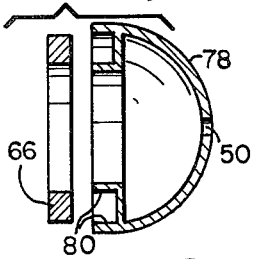

FIGS. 8, 9 and 10 depict other embodiments of the invention wherein the base 68 is fabricated to an annular configuration of magnetic material and the housings 70, 74 and 78 are formed with cooperating flanges 72, 76 and 80, respectively, to prevent sideways movement of the housings relative to the bases when magnetically attached to the bases. The invention may be further modified by providing flanges on both the base and the housing if so desired.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. A protective device to cover a locking mechanism installed in an openable construction member comprising, a magnetically attractive base secured around the locking mechanism, the base being permanently secured to the construction member; and a rigid, removable housing overfitting the locking mechanism and comprising a magnetic portion for magnetically securing said housing to said base, the housing comprising an aperture, the said aperture being adapted to allow insertion of a separate tool to dislodge the housing from the base.

2. The device of claim 1 wherein the magnetically attractive base comprises a ferrous body, the body being configured to extend peripherally outwardly from the locking mechanism.

3. A protective device to removably cover a locking mechanism comprising, a magnetically attractive base secured around the locking mechanism; and a removable housing overfitting the locking mechanism and having a magnetic portion for magnetically securing said housing to said base and for enclosing said locking mechanism, the housing comprising removal means to allow insertion of a separate tool to dislodge the housing from the base, the said base comprising a flange extending outwardly therefrom, said flange being adapted to engage a portion of said housing to prevent relative sliding movement of the housing with respect to the base.

4. A device for protecting a locking mechanism installed in a building construction member comprising a permanently magnetic base disposed around the locking mechanism; and a removable housing having an edge of magnetically attractive material for securing said housing to said base member and for enclosing said locking mechanism, the housing being provided with an aperture to allow insertion of a separate tool to dislodge the housing from the magnetic member.

5. The device of claim 4 wherein the construction member is a door and the locking mechanism comprises a door knob, wherein said magnetic base is flat and circular, the base being attached to the door in position to surround the door knob.

6. The device of claim 4 wherein said magnetic base comprises a flange extending outwardly therefrom, the flange being adapted for engagement with a surface of the said housing.

7. The device of claim 4 wherein said base comprises an opening surrounding the locking mechanism and the housing comprises a flange, the dimensions and configuration of the flange being adaptable for insertion into the said base opening, whereby sliding sideways movement of the housing relative to the base is prevented.

* * * * *